US007655861B2

(12) United States Patent
Duley

(10) Patent No.: US 7,655,861 B2
(45) Date of Patent: Feb. 2, 2010

(54) GROUNDING AND ENERGY DISPERSION SYSTEM

(76) Inventor: Wayne C. Duley, 4711 Tabscott Rd., Kents Store, VA (US) 23084

( * ) Notice: Subject to any disclaimer, the term of this patent is extended or adjusted under 35 U.S.C. 154(b) by 222 days.

(21) Appl. No.: 11/980,870

(22) Filed: Oct. 31, 2007

(65) Prior Publication Data

US 2008/0164046 A1 Jul. 10, 2008

Related U.S. Application Data

(60) Provisional application No. 60/878,785, filed on Jan. 6, 2007.

(51) Int. Cl.
*H01R 4/66* (2006.01)

(52) U.S. Cl. ..... 174/6; 174/3; 174/5 R; 174/51; 174/40 CC; 174/78; 439/98; 361/753

(58) Field of Classification Search ..... 174/3, 174/6, 5 R, 51, 78, 40 CC, 75 C; 439/800, 439/98, 92, 100; 361/753, 799
See application file for complete search history.

(56) References Cited

U.S. PATENT DOCUMENTS

| | | | | |
|---|---|---|---|---|
| 196,518 | A | 10/1877 | Brown | |
| 362,062 | A | 5/1887 | Cole | |
| 1,013,305 | A | 1/1912 | Pardee | |
| 1,243,774 | A | 10/1917 | Soengen | |
| 2,739,998 | A | 3/1956 | Kretzer | |
| 5,337,836 | A * | 8/1994 | Williams | 173/90 |
| 5,581,962 | A * | 12/1996 | Davis et al. | 52/148 |
| 6,498,291 | B2 | 12/2002 | Brammer | |
| 6,828,504 | B1 * | 12/2004 | Schmidt | 174/75 C |
| 7,104,343 | B2 * | 9/2006 | Roberts | 175/40 |
| 7,465,874 | B2 * | 12/2008 | Obleman, Jr. | 174/6 |
| 2006/0012938 | A1 | 1/2006 | Park | |

* cited by examiner

*Primary Examiner*—Dhiru R Patel
(74) *Attorney, Agent, or Firm*—Williams Mullen

(57) ABSTRACT

A surge protector which has a metal grounding plate having holes and tubular sleeve guides, standard UL-approved ground rods that are inserted through the sleeve guides and are affixed to the sleeve guides using a durable exothermic weld, and leads attached at one end to the grounding plate also using an exothermic weld to affix any number of grounding devices, traditional ground rings, electronic equipment, structures, sites or combinations thereof. The durable exothermic weld is a permanent connection that stands in contrast to commonly used mechanical connections. The present invention also has a minimal footprint requirement allowing for placement in areas where space limitations are unsuitable for placement of conventional grounding rings. The present invention can be used in combination with or in lieu of conventional grounding rings.

9 Claims, 8 Drawing Sheets

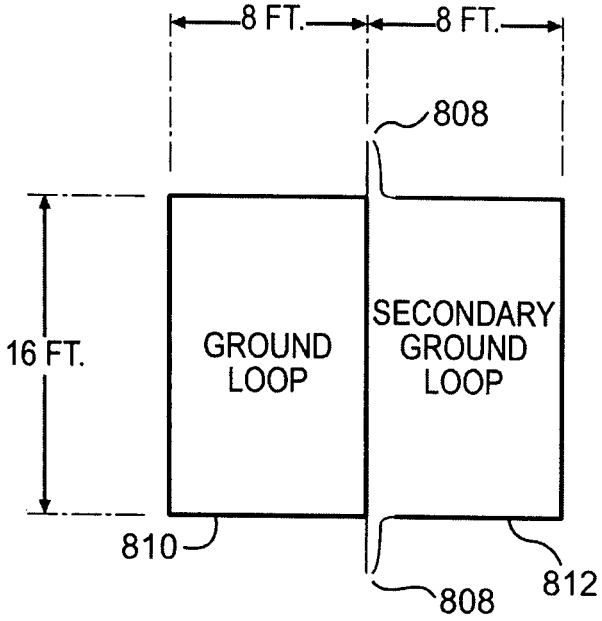

FOUR CORNER GROUND RODS -16 FOOT GROUND LOOP 810-73.3 OHMS

8 X 16 FOOT GROUND LOOP 810- 56.4 OHMS (6 GROUND RODS)

8 X 16 FT. GROUND LOOP 810 PLUS SECONDARY GROUND LOOP 812 - 40.5 OHMS (9 GROUND RODS) (28% DROP)

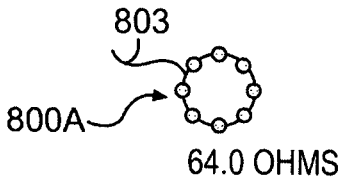

GROUND LOOP 810 PLUS TEST SYSTEM 800A- 35.4 OHMS (37.2% DROP)

GROUND LOOP 810, TEST SYSTEM 800A- PLUS SECONDARY GROUND LOOP 812 29.9 OHMS (15.5% DROP)

GROUND LOOP 810, BOTH TEST SYSTEMS 800A,800B- 27.8 OHMS (7% DROP)

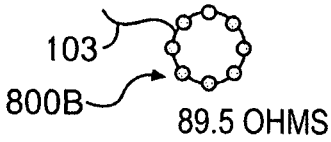

GROUND LOOP 810, BOTH TEST SYSTEMS 800A,800B AND SECONDARY GROUND LOOP 812- 23.8 OHMS (14.4% DROP)

*FIG. 8*

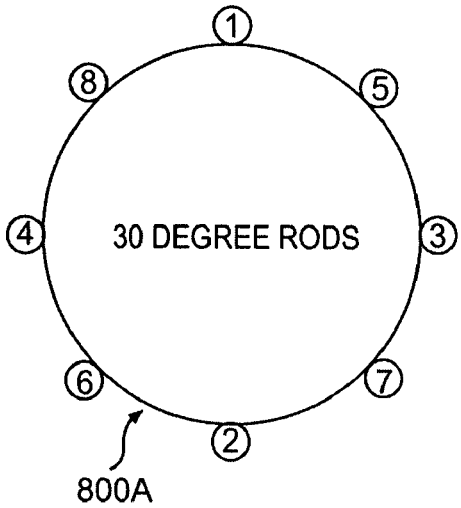
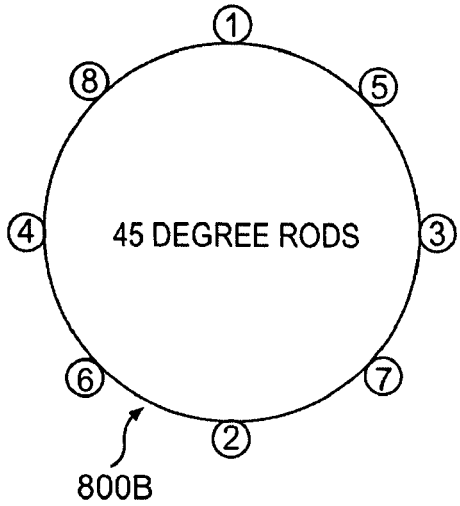
900
TEST SYSTEM 800A
| # OF RODS | OHM READING |
|---|---|
| 1 | 233 |
| 2 | 136 (41.6%) |
| 3 | 108.4 (20%) |
| 4 | 90.6 (16.3%) |
| 5 | 81.9 (9.6%) |
| 6 | 71.6 (12.6%) |
| 7 | 67.8 (5.3%) |
| 8 | 64.9 (4.3%) |
TOTAL RESISTANCE DROP IS 72.1%
TEST SYSTEM 800B
| # OF RODS | OHM READING |
|---|---|
| 4 | 136.1 |
| 8 | 89.5 |
SYSTEMS 800A,800B FULLY INSTALLED AND CONNECTED TOGETHER HAD A READING OF 46.4 OHMS.
*FIG. 9*

GROUNDING AND ENERGY DISPERSION SYSTEM

RELATED U.S. APPLICATION DATA

This application claims priority to provisional application No. 60/878,785, filed on Jan. 6, 2007, which is hereby incorporated by reference.

FIELD OF INVENTION

This invention relates generally to a grounding and energy dispersion system that protects items from damaging current and voltage surges.

BACKGROUND OF THE INVENTION

Grounding and energy dispersion systems are well known in the art and have been used historically to prevent current and voltage surges from damaging sites, structures, and electrical equipment. Conventional grounding systems include discrete ground rods, discrete ground plates, ground electrodes, enhanced ground rods and chemical rods. Conventional grounding systems are configured in rings that require a footprint often far exceeding the constraints of the sites, structures or equipment targeted for protection.

SUMMARY OF THE INVENTION

The present invention allows for harnessing and dispersion of a current or voltage surge in combination with or in lieu of a conventional grounding ring. The present invention has a minimal footprint requirement, allowing for placement in areas where space limitations are unsuitable for placement of conventional grounding rings. Additionally, the present invention provides an energy dispersion system using installation of ground rods through multiple sleeve guides mounted on a grounding plate in which the rod-to-plate connection is formed with a durable exothermic weld. This permanent weld stands in contrast to commonly used mechanical welds. The present invention allows for multiple leads to affix any number of grounding devices, traditional ground rings, electronic equipment, sites, structures or combinations thereof. These leads are also mounted onto the grounding plate using a durable exothermic weld.

BRIEF DESCRIPTION OF THE DRAWINGS

FIG. 8 shows the results of resistance studies for the present invention.

FIG. 9 shows resistance based on the angle of incidence of the sleeve guides and ground rods.

DETAILED DESCRIPTION OF THE PREFERRED EMBODIMENTS

Figure 1:
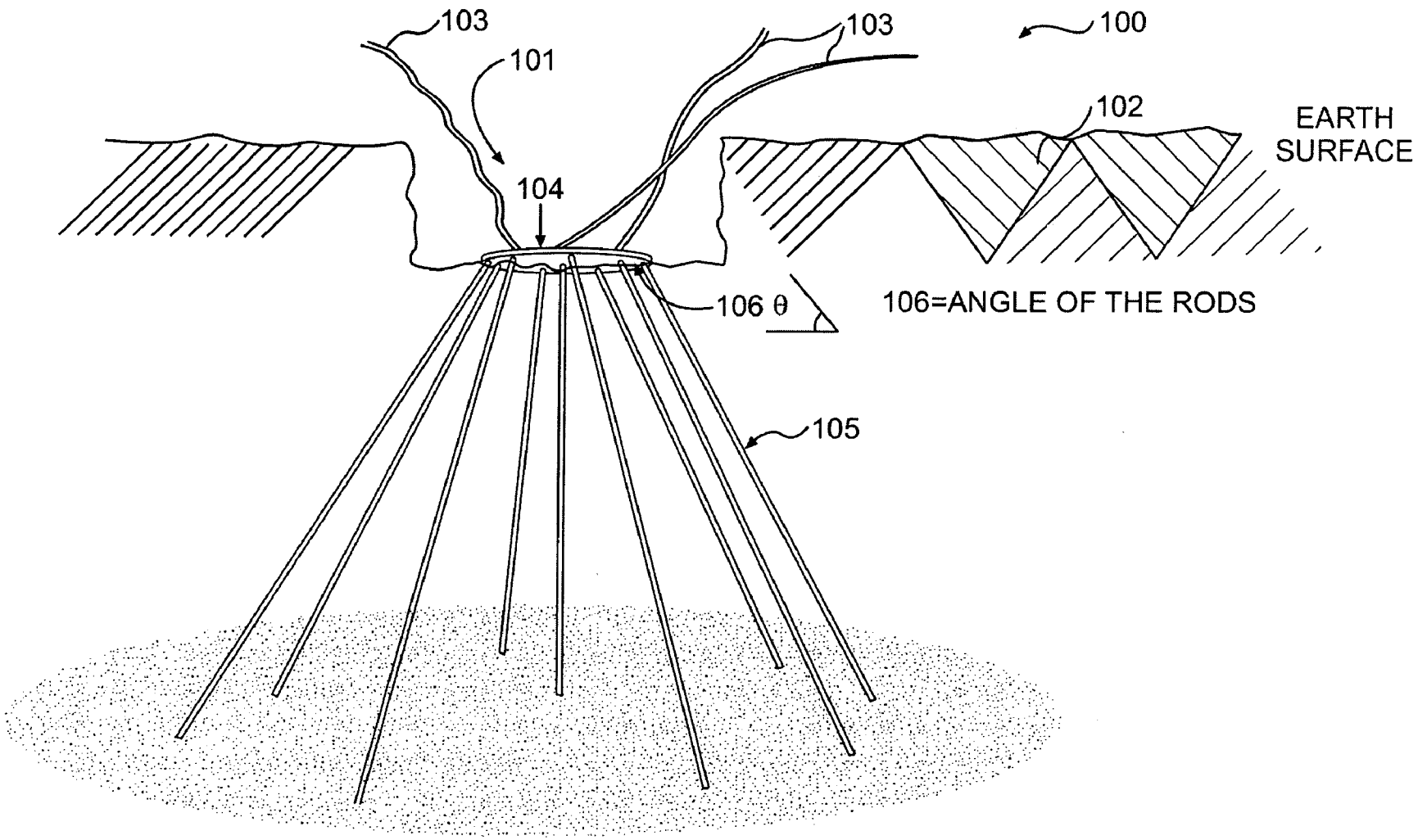
FIG. 1 shows a side view of an installed grounding and energy dispersion system.

FIG. 1 shows a below perspective view of an installed grounding and energy dispersion system 100 situated within an installation hole 101 dug in the earth 102. The installation hole 101 may have a 40-inch diameter and 24-inch depth, for example, demonstrating a small surface footprint with at least one conductive lead 103 connected to a conductive grounding plate 104 at one end and (initially) unattached at the opposite end and, in this example, nine elongated conductive ground rods 105 inserted into and attached to the grounding plate 104 at a desired angle 106. Note that as shown, angle 106 is such that ground rods 105 extend a horizontal distance beyond ground plate 104. Of course, ground plate 104 may be any of a variety of conductive materials, such as galvanized metals, carbon steel, stainless steel, monel, copper, copper clad metals, bronze, etc.

Figure 2:
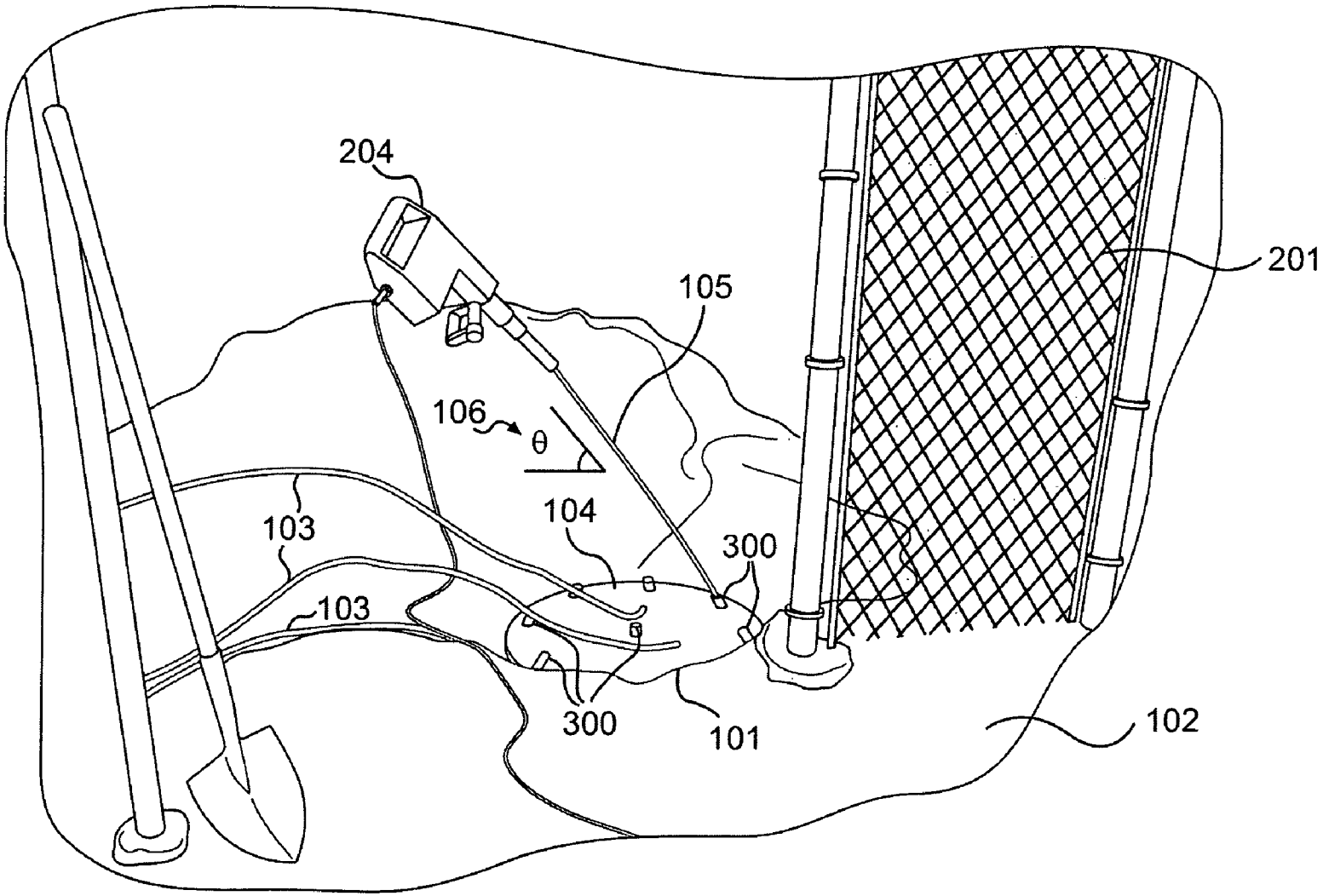
FIG. 2 shows an above ground view of an installed grounding and energy dispersion system.

FIG. 2 shows an above perspective view of a partially installed grounding and energy dispersion system 100, situated next to a fence 201 in an installation hole 101 dug in the earth 102, with leads 103 affixed to grounding plate 104. In this example, one of the ground rods 105 is partially inserted at an angle 106 to grounding plate 104. Ground rods 105 may be installed within sleeve guide 300 using an impact hammer 204, or similar such device.

Figure 3:
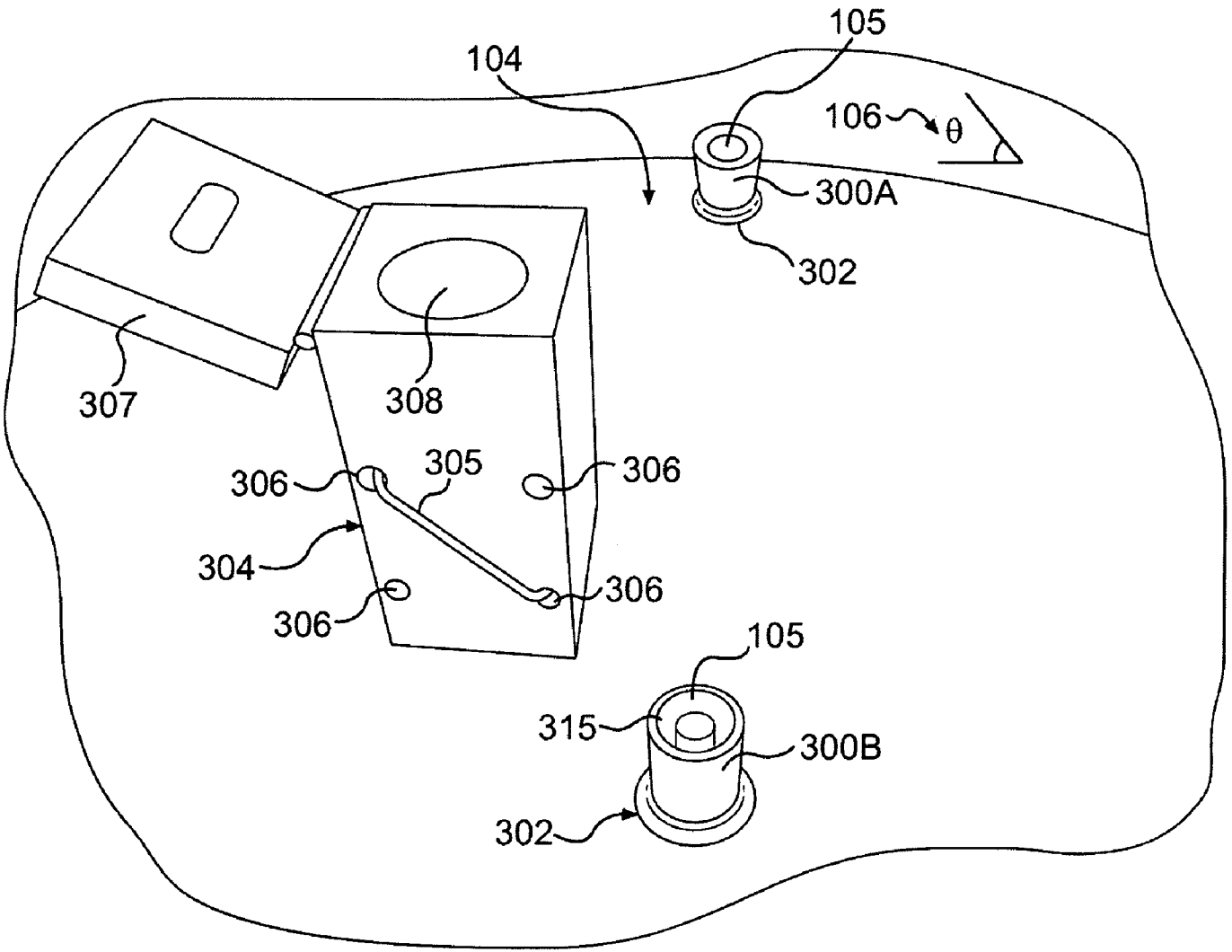
FIG. 3 shows sleeve guides with and without an inserted rod and an exothermic mold.

FIG. 3 shows an embodiment having a 30° angled sleeve guide 300A attached by a conventional weld 302 to a galvanized metal grounding plate 104 and a 90° angled sleeve guide 300B attached by a conventional weld 302 to the galvanized metal grounding plate 104. The 90° angled sleeve guide 300B is also shown, containing an inserted and sawed-off grounding rod 105 inside and cut flush with the distal end of the 90° sleeve guide 300B, as may be seen in the sleeve guide's 300 distal opening. The sleeve guides 300A and 300B are preferably reamed at the end distal to the grounding plate 104 to expand the inner diameter of sleeve guides 300 to form a circular annulus 315 between outer diameter of inserted ground rod 105 and the inner diameter of distal end of sleeve guide 300; annulus 315 receives the welding compound that facilitates an exothermic weld between sleeve guide 300 and grounding rod 105. Atop the metal grounding plate 104 and alongside the angled sleeve guides 300 is a custom exothermic mold 304 that fits a 30° or 90° angled sleeve guide. Of course, design of mold 304 may be adapted for other desired angles, provided only that it is adapted to the angle 106 of angled sleeve guides 300. On the sides of the custom exothermic mold 304 are removable handles 305 inserted in handle holes 306 for securing handle 305 of the exothermic mold 304. The exothermic mold 304 may have a lid 307 and a cavity 308 for pouring the welding compound into annulus 315 formed at the inner diameter of sleeve guide 300 when grounding rod 105 has been inserted.

Figure 4:
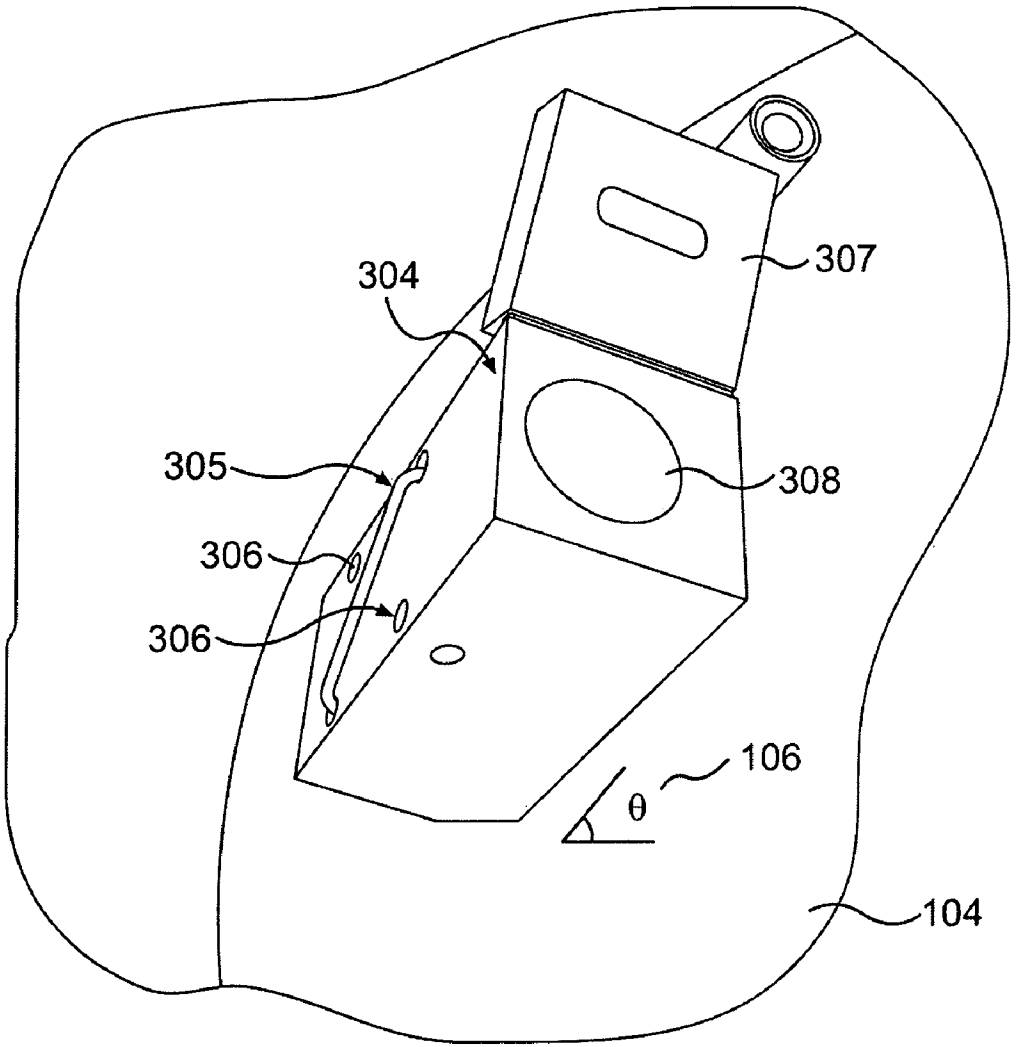
FIG. 4 shows an exothermic mold mounted on a 30° angled sleeve guide.

FIG. 4 shows a top view of a grounding plate 104 with exothermic mold 304 fitted over a 30° angled sleeve guide 300, not shown (hidden by exothermic mold 304). The exothermic mold 304 aligns with and fits over the sleeve guide 300, while preserving the desired angle 106 of the sleeve guide 300.

Figure 5:
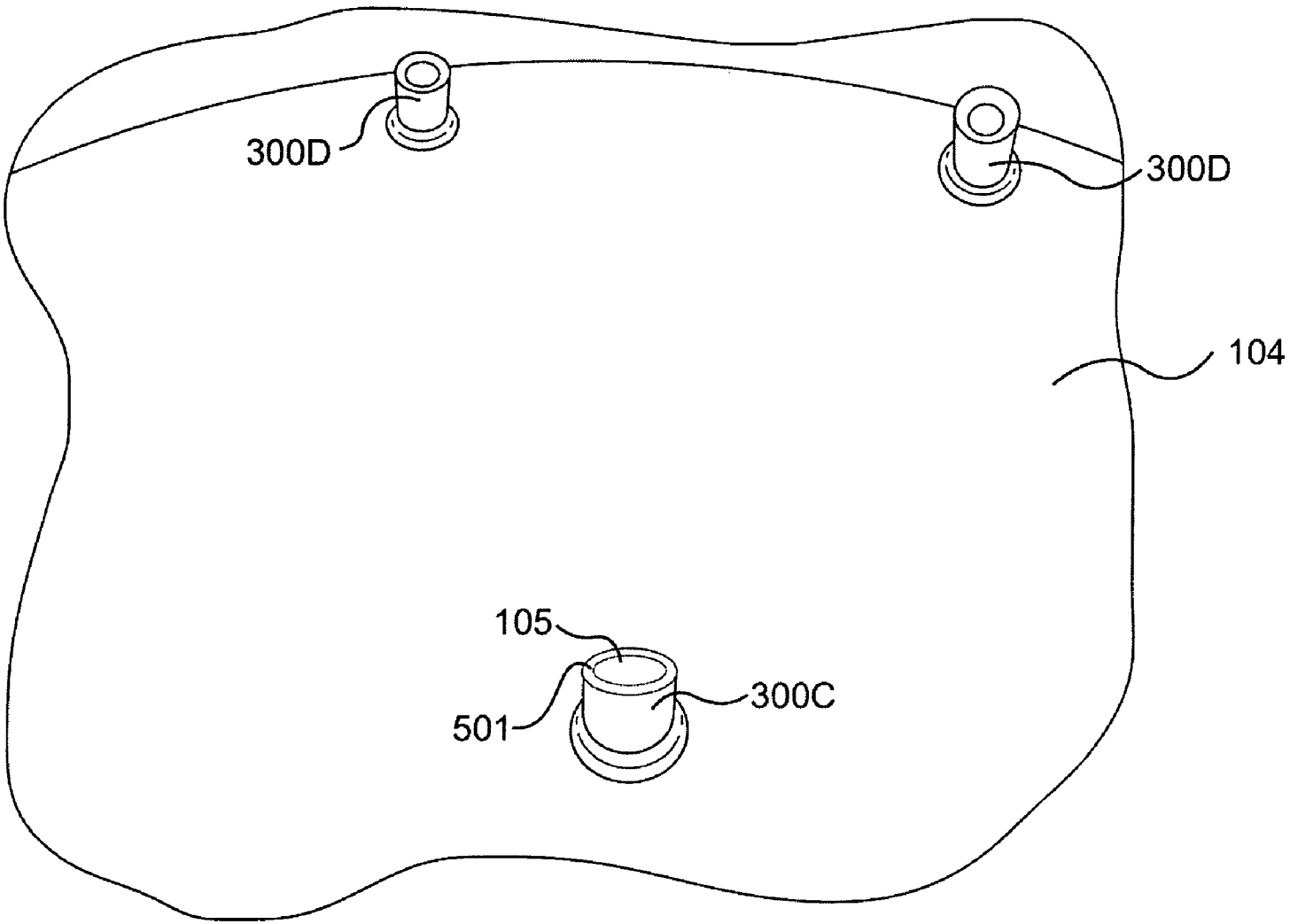
FIG. 5 shows multiple sleeve guides one with an exothermic weld.

FIG. 5 shows a galvanized metal grounding plate 104 with a sleeve guide 300C containing a ground rod 105 with slag 501 on top of the distal end of sleeve guide 300C. The slag 501 is waste from the exothermic weld process, which may be removed from the distal end of sleeve guides 300 after molding. The completed exothermic weld bonds grounding rod 105 to sleeve guide 300C. Also shown are two sleeve guides 300D without installed grounding rods 105.

Figure 6:
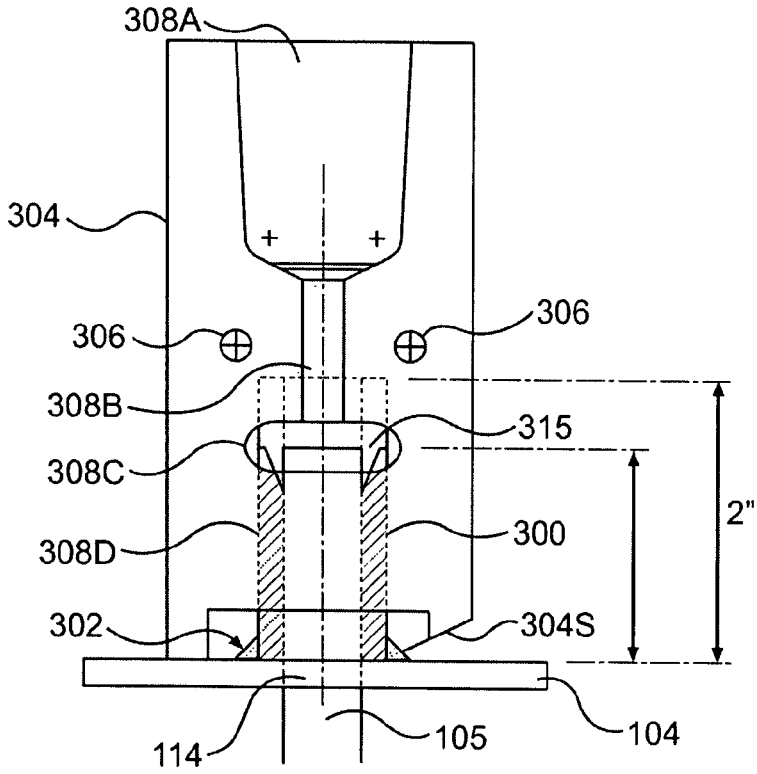
FIG. 6 shows an exothermic mold fitted over a 90° angled sleeve guide.

FIG. 6 shows a diagram of a cut away view of an embodiment of exothermic mold 304 fitted over a 90° angled sleeve guide 300. Cavity 308 of exothermic mold 304 may include subsections in communication with each other, such as guide receptacle 308D adapted to receive sleeve guide 300 with ground rod 105 inserted therein. Ignition cavity 308A is connected to mold cavity 308C via passage 308B. Mold cavity 308C is in communication with guide receptacle 308D. Sleeve guide 300 may be attached or affixed to grounding plate 104 by a conventional weld 302, or by other conductive means. Guide receptacle 308D may also be adapted to accommodate the structure of such affixation, as shown. Note annulus 315 formed by outer diameter surface of ground rod 105 and the inner diameter surface at the distal end of sleeve guide 300. By way of example without limitation, the sleeve guide 300 in this embodiment may be 2 inches high with an inner diameter of ¾ inches and an outer diameter of 1¼ inches. Of course, other sizes may serve, so long as the dimensions are coordinated with the dimensions of ground rod 105. On the sides of exothermic mold 304 are shown handle holes 306 for securing removable handles 305 (not shown). Angled surface 304S of exothermic mold 304 may be provided for use with angled sleeve guides 300.

Figure 7:
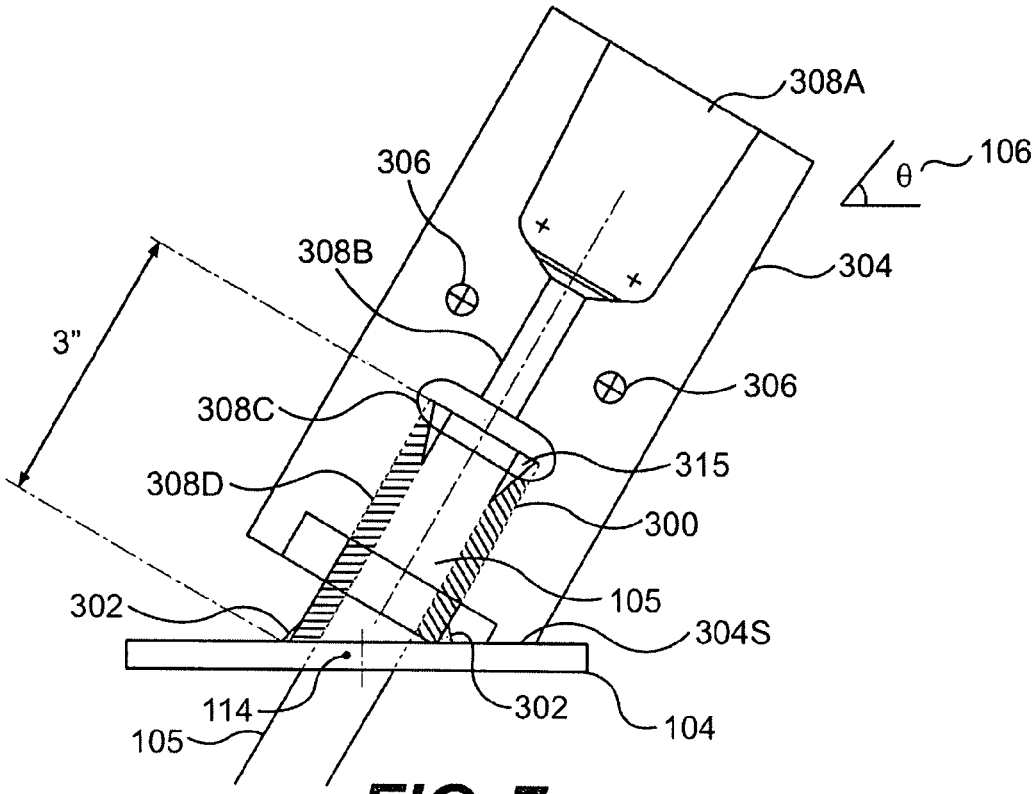
FIG. 7 shows an exothermic mold fitted over a 30° angled sleeve guide.

FIG. 7 shows a diagram of a cut away view of an embodiment of the exothermic mold 304 fitted over an angled sleeve guide 300, which is attached to a grounding plate 104. In this aspect, angled surface 304S is flush with grounding plate 104 to enable exothermic mold 304 to accommodate angled sleeve guide 300. Angled sleeve guide 300 enables ground rod 105 to be inserted into grounding plate 104 at angle 106 so that ground rod 105 may extend a desired horizontal distance beyond the grounding plate 104. An effect of such extension is to improve the effectiveness of system 100 for dissipating charge over a larger subterranean area without requiring an increase in area of installation. By way of example for this embodiment, the sleeve guide 300 in this illustration may be 3 inches on the long side, with an inner diameter of ¾ inches and an outer diameter of 1¼ inches. Of course, other sizes may serve, so long as the dimensions are coordinated with the dimensions of ground rod 105.

FIG. 8 shows the results of resistance studies of two installed grounding and energy dispersion systems 800A and 800B each installed with 8 identical grounding rods 801 and having connecting leads 803 and 804 connected variously with a ground loop 810 and a secondary loop 812 with a connecting lead 808.

FIG. 9 shows the results 900 of the resistance study results of two grounding and energy dispersion systems 800A and 800B as grounding rods 801 are installed at 30° in grounding system 800A and at 45° in grounding system 800B.

Thus, the grounding and energy dispersion system 100 comprises a grounding plate 104, tubular sleeve guides 300, standard UL-approved ground rods 105 that are inserted through the sleeve guides 300 and insertion holes 114 and into the earth 102, and leads 103 that may be affix to any item to be grounded or any number of additional grounding devices, such as traditional ground rings.

The grounding plate 104 will preferably meet NEC requirements. It may be machine cut from a sheet of flattened conductive metal, with one or more insertion holes 114 placed in or defined by grounding plate 104 in a desired pattern, such as around the perimeter of grounding plate 104. The insertion holes 114 are sized to accommodate and correspond to the outer diameter of any ground rod 105, which preferably is a standard UL-approved pipe. The tubular sleeve guides 300 may be formed using tubular or hollow pipe cut into the desired lengths. Sleeve guides 300, being tubular have distal and proximal openings, and are generally superposed at its proximal end about the perimeter of insertion holes 114 during affixation to grounding plate 104. The height of the sleeve guide 300 may vary so long as the length is sufficient to maintain the pre-determined and affixed angle 106 of the sleeve guide 300 during installation of the ground rods 105. The sleeve guides 300 may be welded or otherwise conductively affixed to the grounding plate 104 at such pre-determined angle 106. Insertion holes 114 may also be formed to accommodate angle 106. The interior diameter of the sleeve guide 300 may be reamed or otherwise expanded at the end distal to ground plate 104. This provides, upon insertion of ground rod 105, annulus 115 for receiving welding compound known in the industry to facilitate an exothermic weld. The ground plate 104 with sleeve guides 300 may then be galvanized.

Ground rods 105 may be inserted into the earth 102 through the sleeve guides 300 and insertion holes 114 so as to contact the earth 102. After installation of the ground rods 105 through the sleeve guides 300, the ground rods 105 may be cut flush or near-flush with the distal end of sleeve guides 300 and connected to the sleeve guides 300 using a durable exothermic weld at annulus 115.

Exothermic mold 304 and sleeve guides 300 are preferably designed to mate together, in that exothermic mold 304 may fit over the sleeve guide 300, which is affixed to the grounding plate 104 at a pre-determined angle. Exothermic mold 304 may be created out of a variety of heat resistant materials, such as, but not limited to graphite.

The exothermic mold 304 is thus capable of being slid over the sleeve guide 300 when it contains the ground rod 105. A metal tab (not shown) may be added to form a cap over the exothermically welded ground rod 105 and sleeve guide 300. A pre-measured shot of exothermic weld material corresponding to the volume of cavity 308 may be poured into the exothermic mold 304 while mated to sleeve guide 300. The shot will fill annulus 115 between ground rod 105 and sleeve guide 300. The exothermic mold 304 may then be closed and ignited to form an exothermic weld; such molding is a durable, conductive connection between the sleeve guide 300 and ground rod 105. Thus, the inserted ground rod 105 and distal opening of sleeve guide 300 are configured to receive exothermic mold 304 and are capable of supporting exothermic welding of ground rod 105 to sleeve guide 300 for a permanent, conductive connection.

The ground rods 105 preferably extend outward and downward from the grounding plate 104 at angles determined by the configuration of the sleeve guide 300. The angle 106 of the sleeve guides 300 is determined relative to the ground plate 104 and may range between about 20° and 90°.

This invention is applicable to any industry where conventional grounding systems are used to protect equipment or structures from damage due to current or voltage surges such as, but not limited to, the telecommunications and energy industries. The following will describe various embodiments suitable to particular applications.

In one embodiment, the grounding plate 104 of system 100 may comprise a 36-inch diameter—¼-inch thick galvanized steel plate, containing eight 1¼-inch diameter holes located around the perimeter of the grounding plate 104, sleeve guides 300 affixed to the grounding plate 104 at a 30° angle, eight copper-clad ground rods 105 that are 10 feet in length with 1¼-inch outer diameter inserted through the sleeve guides 300, cut flush with the distal end of sleeve guides 300 and permanently connected to the grounding plate 104 using an exothermic weld, and three leads 103 also permanently connected to the grounding plate 104 at one end by exothermic weld, allowing for field connections using the opposite end.

In one embodiment, the angle 106 of the sleeve guide 300 welded to grounding plate 104 may be 20°. In another embodiment, the angle 106 of sleeve guide 300 to grounding plate 104 is 30°. In another embodiment, the angle 106 of the sleeve guide 300 to grounding plate 104 is 45°. In another embodiment, the angle 106 of sleeve guide 300 to grounding plate 104 is 90°, so that it is perpendicular to the grounding plate 104 or "straight up."

The height or length of the sleeve guide 300 may vary, so long as the length is sufficient to maintain the pre-determined and affixed angle 106 of the sleeve guide 300 during installation. In one embodiment, for example, the height of the sleeve guide 300 may be 2¾ inches, in another 2¼ inches.

The interior diameter of the sleeve guide 300 may also vary but will preferably be coordinated with the diameter of the ground rods 105 to be used. In one embodiment, the sleeve guide 300 may have an interior diameter of ¾ inch and require use of a correspondingly sized ground rod 105. In another embodiment, the sleeve guide 300 may have an interior diameter of ⅝ inch and require use of a correspondingly sized ground rod 105.

The ground rods 105 may be any length appropriate to the application, including, but not limited to, 4, 8, and 10 feet. With a modification to the sleeve guide 300, they may also be joined together to form 20-, 30-, 40-ft. ground rods 105, etc. Combinations of ground rods 105 should be construed as falling within the scope of meaning of the term "ground rod" 105.

In one embodiment, the grounding and dispersion system 100 comprises a grounding plate 104 that is a "+"-shape. For example, such a grounding plate 104 may be cut from a 36-inch diameter—¼-inch thick galvanized steel plate, containing at least four 1¼-inch diameter insertion holes 114 located at the distal end of each arm of the "+"-shape; that is, each arm would extend 18-inches from a crossing point of the "+" shape. Sleeve guides 300 may be affixed to the grounding plate 104 at the location of and superposed about each insertion hole 114. Such sleeve guides 300 may be affixed with angle 106 being acute, or at a 90° angle. Ground rods 105 may be 10 feet in length with 1¼-inch outer diameter, and are inserted through the sleeve guides 300; the ground rods 105 may be cut flush with the distal end of sleeve guide 300 and permanently connected to the grounding plate 104 using an exothermic weld, and leads 106 may also be connected to grounding plate 104 using an exothermic weld.

In another embodiment, the grounding and dispersion system 100 comprises a grounding plate 104 that is an "x"-shape. For example, such a grounding plate 104 may be cut from a 36-inch diameter—¼-inch thick galvanized steel plate, containing at least four 1¼-inch diameter insertion holes 114 located at the distal end of each arm of the "x"-shape; that is, each arm would extend 18-inches from a crossing point of the "x" shape. Sleeve guides 300 may be affixed to the grounding plate 104 at the location of and superposed about each insertion hole 114. Such sleeve guides 300 may be affixed with angle 106 being acute, or at a 90° angle. Ground rods 105 may be 10 feet in length with 1¼-inch outer diameter, and are inserted through sleeve guides 300, the ground rods 105 may be cut flush with the distal end of sleeve guide 300 and permanently connected to the grounding plate 104 using an exothermic weld, and leads 103 may also be connected to grounding plate 104 using an exothermic weld.

The following field studies were performed to demonstrate the effectiveness of certain embodiments. In the first field study, and prior to beginning the installation and testing of the grounding and energy dispersion system 100, the resistivity of the soil was determined at the test site using a Four Point System Test known to those in the art to provide a standard for comparison. The resistivity profile was measured to a depth of 4 feet, followed by a second test to a depth of 10 feet to obtain baseline measurements.

Following the Four Point System Test, a ground loop 810 and secondary ground loop 812 were installed for comparison purposes, as shown in FIG. 8. Ground loop 810 was simply a conventional 8-ft. by 16-ft. rectangular ring electrode. Secondary ground loop 812 was an 8-ft. by 16-ft expansion of ground loop 810, for a total of 16-ft. by 16-ft. square electrode ring to which conventional ground rods (not shown) might be affixed. Secondary ground loop 812 was connectable to ground loop 810 via coupling wires 808, enabling a variety of configurations. Coupling wire 808 was also used for measurement purposes. The overall distances of ground loops 810, 812 are generally given in feet.

Two grounding and energy dispersion test systems 800A, 800B were also installed. The grounding and energy dispersion test systems 800A, 800B were simply embodiments of system 100 having a round grounding plate 104 of 36-inch diameter with up to eight ground rods 105 (not shown) distributed about the periphery, in the same manner as described above. Test system 800A included guide sleeves 300 (not shown) with angle 106 equal to 30°, while test system 800B included guide sleeves 300 (not shown) with angle 106 equal to 45°. The test systems 800A, 800B are depicted in FIG. 8 as circles with sub-circles denoting the relative location of placement of ground rods 105 (not shown). Both systems used #2 solid copper conductors that were tinned. The test systems 800A, 800B also included leads 103 for test measurements.

The resistances of the ground loops 810, 812, and test systems 800A, 800B were measured in a systematic manner and the results are displayed in FIG. 8 and described herein (n. b., all ground rods 105 used were roughly 8-ft. copper clad ⅝" diameter iron rods.) First, the 16- by 16-foot square encompassing both ground loop 810 and secondary ground loop 812 was measured, placing a ground rod 105 (not shown) at each of the four corners. The reading was 73.3 ohms. Next, the square was divided into two parts, the 8- by 16-foot ground loop 810, and the 8- by 16-foot secondary ground loop 812.

The second reading was of the ground loop 810, which had six ground rods 105 (not shown) spaced 8 feet apart—one at each corner and one midway on each 16-feet long side. The resistance of the ground loop 810 was 56.4 ohms. By adding secondary ground loop 812 with three additional conventional grounding rods 105, the ground resistance reading dropped to 40.5 ohms, a 28-percent drop. Next, the secondary ground loop 812 was disconnected and the ground loop 810 was connected to test system 800A. The resistance of the ground loop 810 connected to one test system 800A was 35.4 ohms, a 37.2-percent drop in resistance.

The next step was to connect the ground loop 810, the secondary loop 812, and one test system 800A. This resulted in a reading of 29.9 ohms, an additional 15.5-percent drop. Then the ground loop 810 was connected to two test systems 800A, 800B to provide a reading of 27.8 ohms. Finally, both the ground loop 810 and the secondary ground loop 812 were connected with both test systems 800A, 800B, which further reduced the reading by 14.4-percent to 23.8 ohms. Test system 800A, alone provided a resistance of about 64 ohms while test system 800B provided a resistance of 89.5 ohms; however, the footprint of test systems 800A, 800B was 7.07-sq. ft., in contrast to the larger ground loops 810, 812 with footprints ranging from 128-256 sq. ft.

Comparing the reading of the ground loop 810 and secondary ground loop 812 using nine ground rods 105 to the final reading in which the ground loop 810 and secondary ground loop 812 were connected to both test systems 800A, 800B produced an overall resistance drop of 58.7-percent.

The resistance of the test systems 800A, 800B were also measured as each ground rod 105 was installed, as shown in FIG. 9. The numbered results correspond to the cumulative number and sequential order of the ground rods 105 that were installed, as also numbered for the sub-circle designation of ground rod 105 relative location with each of test systems 800A, 800B. The cumulative resistance readings are charted next to the corresponding ground rod 105 number, and the percentage of change is listed with the reading. As shown, the resistance decreased with the addition of ground rods.

One test system 800A had sleeve guides 300 (not shown) welded to a 36-inch diameter—¼-inch thick galvanized steel ground plate 104, containing eight 1¼-inch diameter holes located around the circumference of the ground plate 104, sleeve guides 300 were affixed to the ground plate 104 at a 30° angle, while those of test system 800B were at a 45° angle.

All ground rods 105 used in the test were standard ⅝ inches×96 inches, copper-coated soft iron rods. Eight copper-clad ground rods 105 initially 10 feet in length with 1¼-inch outer diameter inserted through the hollow sleeve guides 300 and insertion holes 114, cut flush with the sleeve guide to about 8 ft. length, and permanently connected to the grounding plate 104 using an exothermic weld. The leads 814 were also connected by exothermic weld to the grounding plates 104 of the grounding and energy dispersion test systems 800A, 800B.

The results indicate that there is a difference in the effectiveness based on the angle 106 of incidence of the sleeve guide 300 and ground rods 105. The grounding function appears enhanced by a lower angle 106, such as the 30° angle as compared to the 45° angle as shown by the results in FIG. 9, which illustrate lower resistance with ground rods 105 inserted at 30° versus 45°. Other angles tested as effective ranged between 20° and 90°. In one embodiment, a combination or variety of angles 106 for the grounding rods 105 may be used within the same grounding plate 104. By alternating a 20° with a 30° angle 106, the resistance may be additionally lowered. Also, it is expected that increasing the length of the ground rods 105 may provide additional reduction of resistance.

In summary and conclusion, the present invention allows for harnessing and dispersion of a current or voltage surge in combination with or in lieu of a conventional grounding ring or ring electrode. The present invention also has a minimal footprint requirement allowing for placement in areas where space limitations are unsuitable for placement of conventional grounding rings.

It should be understood that the foregoing description and following examples are provided for purposes of illustration only and are not intended to be limiting unless so specified. Modifications or alternative embodiments can be devised and implemented by those skilled in the art without departing from the spirit of the invention. Accordingly, the present invention is intended to embrace all such alternatives, modifications and variances where appropriate.

What is claimed is:

1. A system for grounding an item to earth and dispersing electrical energy, comprising:

a. at least one elongated conductive ground rod having a desired length and outer diameter;

b. a conductive grounding plate defining at least one insertion hole with a corresponding conductive tubular sleeve guide having an open annulus end and an inner diameter no less than the outer diameter of the at least one ground rod, the tubular sleeve guide conductively affixed to the grounding plate superposed about a perimeter of the insertion hole, and the open annulus end of the tubular sleeve guide adapted to receive the at least one ground rod and to guide it along the tubular sleeve guide and through the at least one insertion hole while maintaining electrical contact between the ground rod and the tubular sleeve guide;

c. wherein, the at least one ground rod is sufficiently elongated relative to the tubular sleeve guide so that when the grounding plate is placed in a desired location on the earth, the at least one ground rod extends beyond the tubular sleeve guide when inserted within the tubular sleeve guide so as to be capable of contacting earth;

d. an exothermic mold having at least one side surface, a bottom surface, a top surface, and defining a cavity comprising a guide receptacle in the bottom surface adapted to receive the tubular sleeve guide, an ignition cavity in communication with the tubular sleeve guide, a mold cavity opening to the top surface for receiving a shot of exothermic weld material, a passage connecting the mold cavity and the ignition cavity, a lid for a covering the mold cavity;

e. further wherein, the at least one ground rod and the annulus end of the tubular sleeve guide are configured to fit within the guide receptacle of the exothermic mold capable of supporting exothermic welding of the at least one ground rod to the tubular sleeve guide, whereby a durable and permanent connection can be made between the ground rod and tubular sleeve guide;

f. at least one conductive lead affixed to the grounding plate by durable exothermic weld and capable of conductive contact with an item to be grounded; and g. wherein, the at least one ground rod is configured so as to extend a desired horizontal distance beyond the grounding plate when inserted into the at least one tubular sleeve guide.

2. The system according to claim 1, wherein the at least one elongated conductive ground rod is a plurality of elongated conductive rods and the at least one hole with a corresponding conductive tubular sleeve guide is a plurality of holes with corresponding conductive tubular sleeve guides.

3. The system according to claim 1, wherein the tubular sleeve guides further comprise a larger inner diameter at the annulus end than the inner diameter of the tubular sleeve guide thereby creating a circular annulus to receive filler material for supporting exothermic welding of the ground rod to the tubular sleeve guide.

4. The system according to claim 1, wherein the tubular sleeve guides are affixed to the grounding plate at a predetermined angle.

5. The system according to claim 1, wherein the tubular sleeve guides are affixed to the grounding plate at a predetermined angle between 20 degree and 90 degree and the bottom surface of the exothermic mold provides an angled surface so that the exothermic mold is adapted for use with the tubular sleeve guides affixed to the grounding plate in at least two pre-determined angles.

6. The system according to claim 1, wherein the tubular sleeve guides are about 2¾ inches in height.

7. The system according to claim 1, wherein the tubular sleeve guides are about 2¼ inches in height.

8. The system according to claim 1, wherein the grounding plate is a round ¼-inch thick steel plate having about a 36-inch diameter and defining eight or more holes around the perimeter of the grounding plate.

9. A grounding system kit for grounding an item to earth and dispersing electrical energy, comprising:

a. at least one elongated conductive ground rod having a desired length and outer diameter;

b. a conductive grounding plate defining at least one insertion hole with a corresponding conductive tubular sleeve guide having an open annulus end and an inner diameter no less than the outer diameter of the at least one ground rod, the tubular sleeve guide conductively affixed to the grounding plate superposed about a perimeter of the insertion hole, and the open annulus end of the tubular sleeve guide adapted to receive the at least one ground rod and to guide it along the tubular sleeve guide and through the at least one insertion hole while maintaining electrical contact between the ground rod and the tubular sleeve guide;

c. wherein, the at least one ground rod is sufficiently elongated relative to the tubular sleeve guide so that when the grounding plate is placed in a desired location on the earth, the at least one ground rod extends beyond the tubular sleeve guide when inserted within the tubular sleeve guide so as to be capable of contacting earth;

d. an exothermic mold having at least one side surface, a bottom surface, a top surface, and defining a cavity comprising a guide receptacle in the bottom surface adapted to receive the tubular sleeve guide, an ignition cavity in communication with the tubular sleeve guide, a mold cavity opening to the top surface for receiving a shot of exothermic weld material, a passage connecting the mold cavity and the ignition cavity, a lid for a covering the mold cavity;

e. further wherein, the ground rod and the annulus end of the tubular sleeve guide are configured to fit within the guide receptacle of the exothermic mold and the exothermic mold is capable of exothermic welding of the ground rod to the tubular sleeve guide, whereby a durable and permanent connection can be made between the ground rod and tubular sleeve guide;

f. at least one conductive lead affixed to the grounding plate by durable exothermic weld and capable of conductive contact with an item to be grounded; and g. wherein, the at least one ground rod is configured so as to extend a desired horizontal distance beyond the grounding plate when inserted into the at least one sleeve guide.

* * * * *